US006347849B1

(12) United States Patent
Müterthies et al.

(10) Patent No.: US 6,347,849 B1
(45) **Date of Patent: *Feb. 19, 2002**

(54) PULL-OUT SLIDE FOR DRAWER OR THE LIKE

(76) Inventors: Ralf Müterthies, Benningsfeld 21, 35284 Lohne; Carsten Meyer, Huchstr. 32, 33729 Bielefeld; Jorg Aufderheide, Diemkerstr. 82, 32139 Spenge; Stefan Rüter, Wulferdingser Str. 65; Gerard Schröder, Worthgarten 2, both of 32549 Bad Oeynhausen; Eyyahi Dincdemir, Herrendienstweg 104, 32120 Hiddenhausen, all of (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/610,936

(22) Filed: Jul. 5, 2000

(30) Foreign Application Priority Data

Jul. 9, 1999 (DE) ..... 199 31 842

(51) Int. Cl.[7] ..... A47B 88/04

(52) U.S. Cl. ..... 312/334.12; 312/334.1; 384/19

(58) Field of Search ..... 312/330.1, 334.1, 312/334.7, 334.12, 334.13, 334.15, 334.18, 334.21, 334.25, 334.26, 334.33, 334.37, 334.39, 334.42; 384/19, 20

(56) References Cited

U.S. PATENT DOCUMENTS 4,752,143 A * 6/1988 Lautenschlager, Jr. ..... 384/19
4,799,802 A * 1/1989 Lautenschlager ..... 384/19
5,314,253 A * 5/1994 Grass, Jr. ..... 384/19
5,570,943 A * 11/1996 Schroder et al. .... 312/334.13 X
5,769,518 A * 6/1998 Grabher ..... 312/334.12 X
6,132,020 A * 10/2000 Schael et al. ..... 312/334.1

FOREIGN PATENT DOCUMENTS

DE 3127701 * 2/1983
DE 3623743 * 1/1988
DE 4443063 * 12/1995
DE 29807540 * 7/1998

* cited by examiner

*Primary Examiner*—James O. Hansen

(57) ABSTRACT

A pull-out slide for drawers, working leaves and other pull-out furniture parts has at least two guide rails which are displaceable in the longitudinal direction by bearing units. One guide rail is fastenable to a stationary part such as a furniture body, and another guide rail is fastenable to the pull-out furniture part. A bearing unit held between two guide rails may comprise several cylindrical roller bodies with axes of rotation perpendicular to the displacement direction. At least one roller body of a bearing unit, in the installed condition, is essentially horizontal between two guide rails, and two roller bodies are arranged so that the three axes of the three respective roller bodies form a triangle orthogonal to the displacement direction. One guide rail has a supporting web formed thereon. The supporting web extends between the first and second roller bodies into the triangle formed by the roller body axes, and engages the triangle formed by the roller body axes, so that a guide rail holds the sloped roller bodies together, thereby preventing the separation of the roller bodies.

13 Claims, 6 Drawing Sheets

Fig. 8
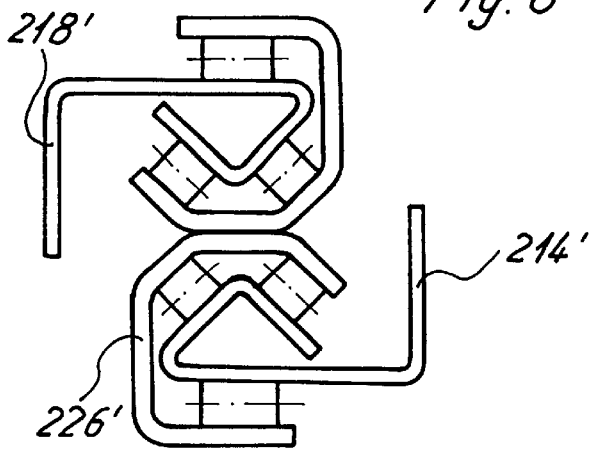
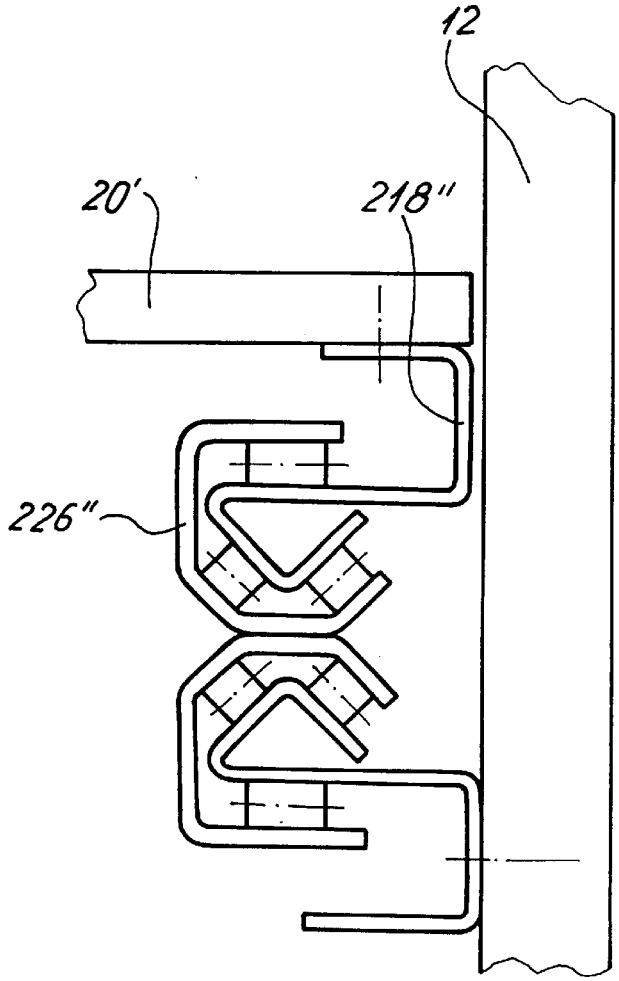
Fig. 9
Fig. 10
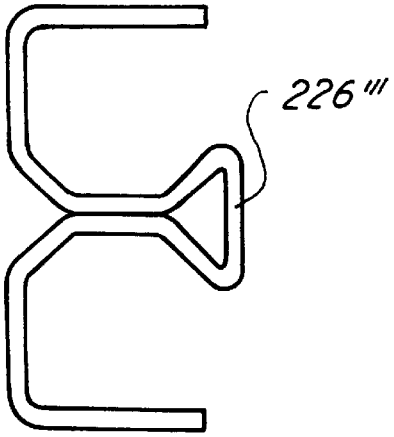

PULL-OUT SLIDE FOR DRAWER OR THE LIKE

BACKGROUND AND SUMMARY OF INVENTION

The invention relates to a pull-out slide for furniture drawers, leaves, or the like. Pull-out slides generally include a guide rail of the pull-out slide fastened to a stationary part, such as the furniture body, and an additional guide rail being fastened to the pull-out furniture part itself. Depending upon the size and the weight of the furniture part to be pulled out, the pull-out slide must absorb vertical forces such as weight of the furniture part. Additionally, the pull-out slide should also ensure a secure lateral guiding.

A pull-out slide of the prior art is disclosed by German Patent Document DE 44 43 063 C1, which shows a first and a third guide profile, each having a general U-shaped construction opening horizontally in the same direction; A second guide rail also has a U-shaped design and opens in the opposite direction, extends between the U-legs of the first and third guide rail. Balls are arranged at both sides of each U-leg of the second guide rail in order to displaceably guide the rail.

The use of balls permits only limited loading since, because of the geometry of the balls, only punctiform contacts exist with the tracks. A flat contact of the balls is eliminated because of the different ball radius relative to the axis of rotation. In addition, because of the limited available space for such pull-out slides, the balls must remain relatively small in order to achieve a favorable surface loading. The space issue was addressed by German Patent Document DE 3127701 A1, which suggests a triangular exterior profile with inside comers having tracks adapted to the diameter of balls. The wall areas of the equilateral triangle forming the inside corners enclose an angle of 60°, which means that the interior profile also must have an acute-angle construction which necessarily permits only very narrow tracks for the balls on the interior profile.

German Patent Document DE 36 23 743 C2 addresses this shortcoming of the prior art by suggesting a pull-out slide with two rails equipped with cylindrical roller bodies whose center axes extend beyond their faces to form a triangle. In contrast to the use of balls, which lack the ability to spread force over a larger area, the entire length of the cylindrical roller body acts to distribute force on the opposite walls. The outer rail forms a hollow profile and has a downward-directed slot which forms the passage for the second rail. The interior of the hollow profile tapers toward the slot such that two rolling paths of the roller bodies are formed which extend at an acute angle with respect to a vertical line.

The disadvantage of the pull-out slide illustrated in German Patent Document DE 36 23 743 C2 is that the two rolling paths, which extend at an angle with respect to one another, an elastic area will spread apart in a wedge-like manner under the effect of a load. In the pulled-out condition, the weight of the furniture part stresses the front area of the pull-out slide downward. In contrast, the rear area of the pull-out slide experiences greater stress in the upward direction, due to a lever-effect. These opposite-acting stresses induce a spreading of the two rails which affects the horizontal roller body and deforms the outer rail such that the running surface becomes curved with respect to the horizontal roller body. The two effects of the spreading necessarily result in poorer running characteristics and a higher wear of the horizontal roller body.

Recognizing these shortcomings of the prior art, the invention further develops the pull-out slide. The guide rails of the present design will resist deformation under a load, thereby enhancing the good running characteristics of the guide rails under relatively large loads.

This object is achieved by means of a pull-out slide for a telescoping furniture part comprising at least one stationary guide rail fastenable to a stationary furniture part and at least one moving guide rail fastenable to a moving furniture part A bearing unit is positioned to allow relative displacement in a longitudinal direction between the stationary guide rail and the moving guide rail.

A bearing unit has several cylindrical roller bodies held between the two guide rails. Axes of the cylindrical roller bodies are generally perpendicular to the displacement direction. For example, at least one first cylindrical roller body is arranged essentially horizontally between the guide rails. Additionally, third and second cylindrical roller bodies are arranged such that their axes of rotation form a triangle in a plane orthogonal to the direction of displacement.

A guide rail may extend around the roller bodies and the guide rail having the supporting web, and also may have a slot for the guiding-through of the supporting web. Moreover, the pull-out slide may be formed so that one guide rail extends around the other guide rail and around the cylindrical roller bodies.

A supporting web is formed on one of the guide rails; the supporting web engages the triangle formed by the roller bodies on an outer rail. The supporting web may have triangularly arranged running surfaces, each running surface respectively engaging a cylindrical roller body. In this embodiment, the supporting web extends interior of the triangle formed by the roller body axes.

A slot in the outer guide rail; which allows the inner guide rail to pass through, does not extend between the two sloped roller bodies. Rather, it extends approximately laterally horizontally in a less loaded area. Thus, when these roller bodies are loaded, a dimensionally stable guiding of all roller bodies is ensured.

The triangular configuration permits a simple manufacturing of the corresponding guide rail at reasonable cost, for example, by edging a metal part.

Alternatively, the reaching-around guide rail may have a pentagonal cross-section, such that three edges of the pentagon serve as running surfaces and two edges connect two running surfaces with one another. The pentagonal cross-section requires more space than the triangular configuration; therefore, one may select a polygonal cross-section that is suited to the design constraints or preferences of the designer.

Preferably, each bearing unit comprises several roller bodies arranged behind one another in the displacing direction. Increased stability is obtained if a bearing unit has several roller bodies arranged behind one another in the displacing direction because the load can be simultaneously distributed to several roller bodies.

In the two-rail embodiment, as the pull-out is moved to the open position, a bearing unit in the front in the pull-out direction is stressed more vertically downward, while is stressed more vertically upward as a result of the lever effect.

The essentially horizontal arrangement of the roller body in this case comprises smaller angles of slope of up to 15°, which may be useful for special applications. The angles of slope of the triangle formed by the roller bodies can also be configured because, for example, in the case of an extensive vertical load and a relatively large amount of space, smaller angles of slope are to be preferred.

Preferably, one guide rail reaches around the roller bodies and the guide rail with the supporting web, and correspondingly has a laterally arranged slot for the guiding-through of the supporting web. In this case, the integral construction of the outer guide rail results in a particularly high inherent stability.

In the two rail embodiment, a portion of the pull-out furniture part remains in the furniture body. True, this may limit the maximal running path of the pull-out slide; however, the construction costs are particularly low.

Another embodiment of the invention is a pull-out slide having three guide rails. Specifically, the pull-out slide has a first guide rail connected with the stationary part and a third guide rail connected with the moving furniture part. The pullout slide further has a second guide rail displaceably disposed with respect to both the first guide rail the third guide rail.

The three-rail embodiment referred to in the preceding paragraph may be formed such that the second guide rail has a C-shaped cross-section and is provided with one bend on each of two free legs of the C-shape. In this embodiment, running surfaces engaging the sloped roller bodies are formed on the bends. Additionally, the two free legs of the second guide rail form one running surface respectively for a horizontally arranged cylindrical roller body and may be connected with one another by a connecting web.

In the three-rail embodiment, a cylindrical roller body may be disposed on the connecting web to contact the first guide rail and the third guide rail at a circumference of the cylindrical roller body.

The three-rail embodiment permits a pulling-out of the furniture part beyond the furniture body. It is also possible to use four or more guide rails so that the maximal running course of the pull-out piece is enlarged.

A compact construction of the embodiment with three guide rails is obtained if the second guide rail has a C-shaped construction and its two free legs are each provided with a bend, on which the running surfaces for the sloped roller bodies are constructed. In this case, the two free legs of the second guide rail each form a running surface for a horizontally arranged roller body and are connected with one another by way of a connecting web, so that only a minimal number of individual components are required for the pull-out slide.

If a roller which, on its circumference, is in contact with the first guide rail and the third guide rail is disposed at the above-mentioned connecting web, a uniform movement of the third and second guide rails relative to the first guide rail is obtained in a simple manner.

In the embodiments with three or more guide rails, the shape of the guide rails can be varied according to the available space and the stress to be expected, in which case the second guide rail or the center guide rails, according to the available space and the respective load, may preferably have a Z-shaped, X-shaped, E-shaped or S-shaped construction.

Other objects, advantages and novel features of the present invention will become apparent from the following detailed description of the invention when considered in conjunction with the accompanying drawings.

BRIEF DESCRIPTION OF THE DRAWINGS

FIG. 8 is a view of a fourth embodiment.

FIG. 9 is a view of a fifth embodiment.

FIG. 10 is a view of a sixth embodiment.

DETAILED DESCRIPTION OF THE PREFERRED EMBODIMENTS

Figure 1:
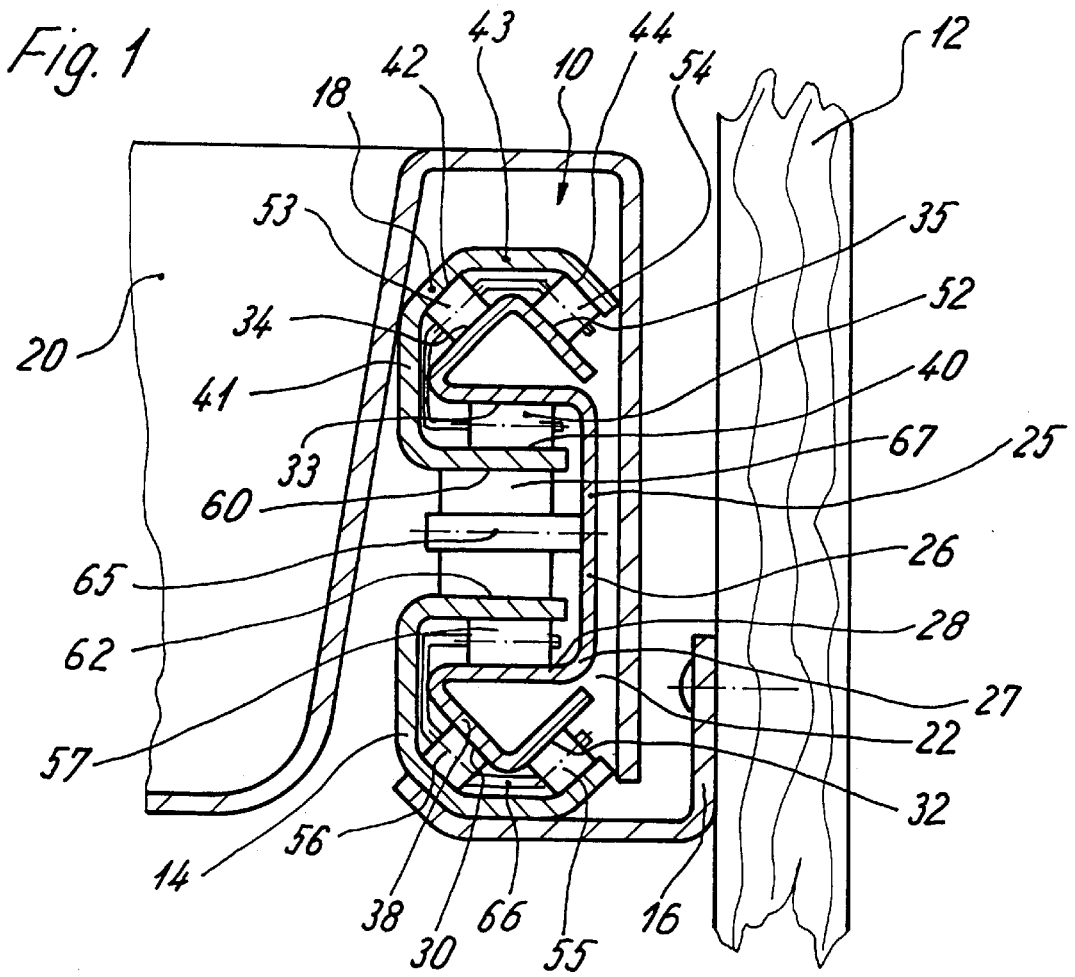
FIG. 1 is a cross-sectional view of a first embodiment of a pull-out slide according to the invention.

FIG. 1 illustrates a first embodiment of a pull-out slide 10 which has a first guide rail 14 connected with the stationary furniture part 12, in this embodiment, the fastening with the furniture part 12 taking place by means of a fastening angle 16. A third guide rail 18 is connected with a drawer 20. This type of fastening is known per se and can be constructed, for example, as a clamped, glued, screwed or riveted connection. The third guide rail 18 can be reinforced by the fastening devices, so that the stiffness of the guide rail 18 is increased, The guide rail 14 is constructed as a hollow profile and has a horizontal/lateral slot 22 pointing to the furniture part 12. The parallel leg 23 of a second C-shaped guide rail 26 engages through this slot 22 of the guide rails 14, the interior surface of the C-leg forming a first running surface 28, and edges produced by edging/bending over forming a third running surface 32 and a second running surface 30. The individual running surfaces 28,.30 and 32 therefore form a triangular guide profile of a supporting web 27 on second guide rail 26.

Cylindrical roller bodies 55, 56, 57, which are made of metal or plastic, roll on the running surfaces 28, 30 and 32. Opposite the running surfaces 28, 30 and 32, corresponding running surfaces are constructed on the first guide rail 14.

In a similar manner, the second guide rail 26 forms running surfaces 33, 34, 35 in the upper area, on which running surfaces roller bodies 52, 53, 54 are arranged which rest against the opposite side on corresponding running surfaces 40, 42 and 44 of the third guide rail 18. As shown in FIG. 1, third rail 18 comprises a generally C-shaped rail having walls 41 and 43 which extend between the running surfaces 40, 42 and 44 of the third guide rail. The cylindrical roller bodies 52, 53, 54, 55, 56, 57 are held in a spaced manner in cradles 66. However, it is also possible to construct the guide rails 14, 18 and 26 such that they hold the roller bodies 52, 53, 54, 55, 56, 57 in position without a cradle.

In this embodiment, the first guide rail 14 can be moved relative to the second guide rail 26, and the second guide rail 26 can be moved relative to the third guide rail 18. In this case, a roller 67 connected with the second guide rail 26 on a connecting web 25 by means of a bearing pin 65 can roll on running surfaces 60,62 of the first and third guide rails 14, 18. This roller 67 can be used for increasing the loading of the entire pull-out slide 1 0 as well as for promoting the synchronous operating sequence of the three guide rails 14, 18, 26 in the sense that the second guide rail 26 carries out half the pull-out movement of the third rail 18.

FIGS. 2 to 10 show modifications of the embodiment illustrated in FIG. 1, the modifications of the guide rails 14, 18 and 26 being shown only schematically because the other components can correspond to the components illustrated in FIG. 1.

Figure 2:
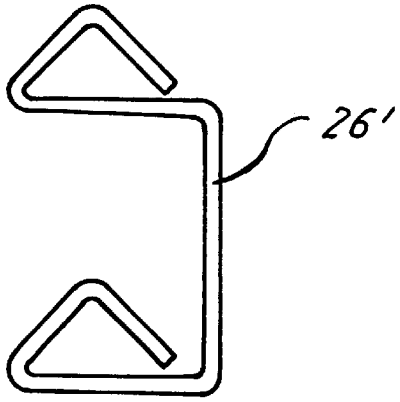
FIG. 2 is a view of a modification of the first embodiment illustrating only the second guide rail.
Figure 3:
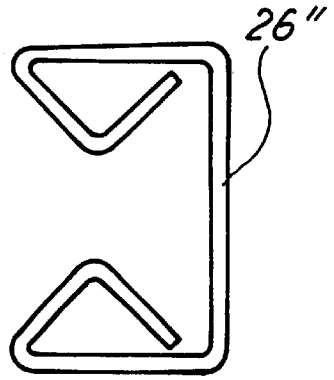
FIG. 3 is a view of a modification of the first embodiment illustrating only the second guide rail.

While according to FIG. 1, the multiple edgings/bends of the second guide rail 26 are directed away from one another, according to FIG. 2, they point in one direction in the case of the second guide rail 26'. As a result, the shape of the guide rail 14 must be adapted to the shape of the guide rail 26'. Without leaving the scope of the invention, according to FIG. 3, the edgings/bends forming the running surfaces may also be directed toward one another between the legs of the second guide rail 26", so that the first and third guide rails have to adapt themselves to this profile with the roller bodies in between.

Figure 4:
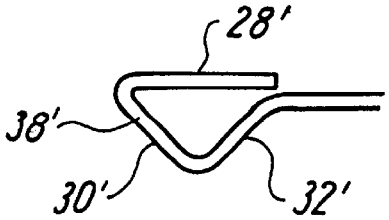
FIG. 4 is a view of a bend of a leg of a guide rail.

FIG. 4 shows another modification of a leg of a guide rail, in which case, by means of a first bending/edging, first the running surface 32' is formed and only then the running surfaces 30' and 32'. The function of the illustrated end otherwise corresponds to that of the lower leg of the second guide rail 26 according to FIG. 1.

Figure 5:
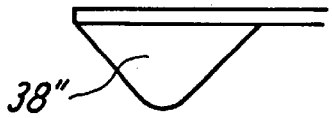
FIG. 5 is a view of a bend of a leg of a guide rail as a massively constructed profile.

As illustrated in FIG. 5, it is within the scope of the invention to produce the running surface not by means of a bent hollow profile made of metal, but by a solid profile 38" connected with the leg of a guide rail. An extruded one-piece profile, for example, may also be provided.

Figure 6:
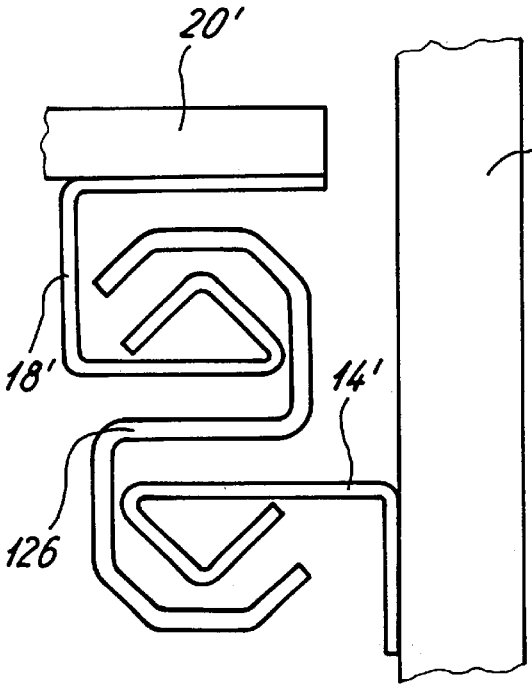
FIG. 6 is a view of a third embodiment with an S-shaped second guide rail.

Instead of using a C-profile as a second guide rail, an approximately S-shaped profile can be used as the second guide rail 126 within the scope of the invention, as illustrated in FIG. 6. In this embodiment, instead of the drawer, a working leaf 20' is connected with the third guide rail 18'. In this case, the second guide rail 126' reaches around the third guide rail 18' and the first guide rail 14', the cylindrical roller bodies being held between the guide rails.

Figure 7:
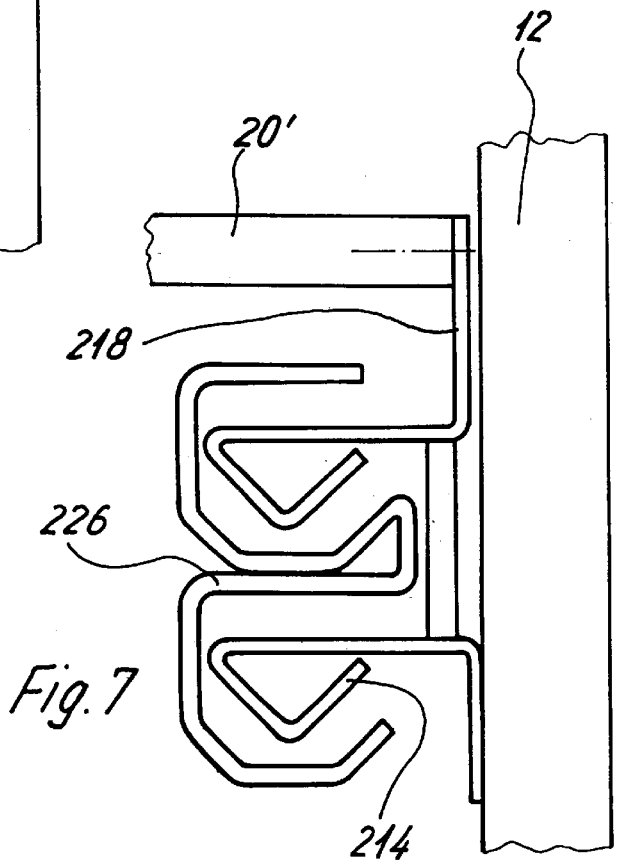
FIG. 7 is a view of a second embodiment with an E-shaped second guide rail.

In FIG. 7, the inside triangles formed by the first guide rail 214 and the third guide 218 both point downward and extend to the right side by means of their supporting webs out of the second guide rail 226, so that the second guide rail 226 becomes E-shaped.

In FIG. 8, the two inside triangles of the first and third guide rail 214', 218' are directed toward one another, and the second guide rail 226' is formed of two individual profiles which are permanently connected with one another by soldering, welding, gluing or in another fashion. FIG. 8 depicts the second guide rail 226' as Z-shaped.

In the embodiment illustrated in FIG. 9, the third guide rail 218" extends out of the second guide rail 226" to the side other than the side of the preceding embodiment. FIG. 10 only shows the second guide rail 226'" in one piece, as it can be used in the pull-out slide illustrated in FIG. 9.

Figure 11:
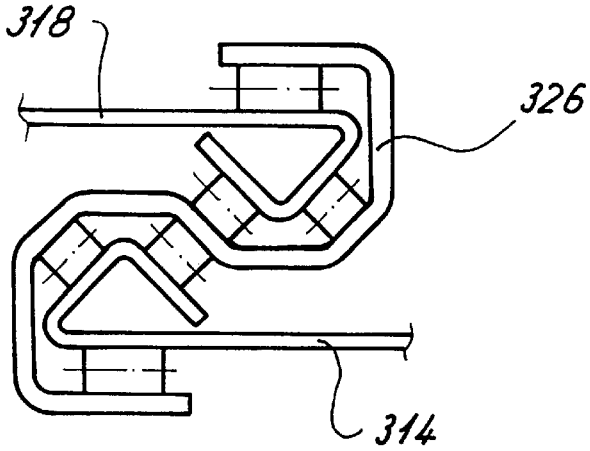
FIG. 11 is a view of a seventh embodiment.

In the embodiment according to FIG. 11, the inside triangles of the first guide rail 314 and of the third guide rail 318 are arranged laterally offset with respect to one another, so that the roller bodies arranged between the two inside triangles rest against opposite sides of the same section of the second guide rail 326.

Figure 12:
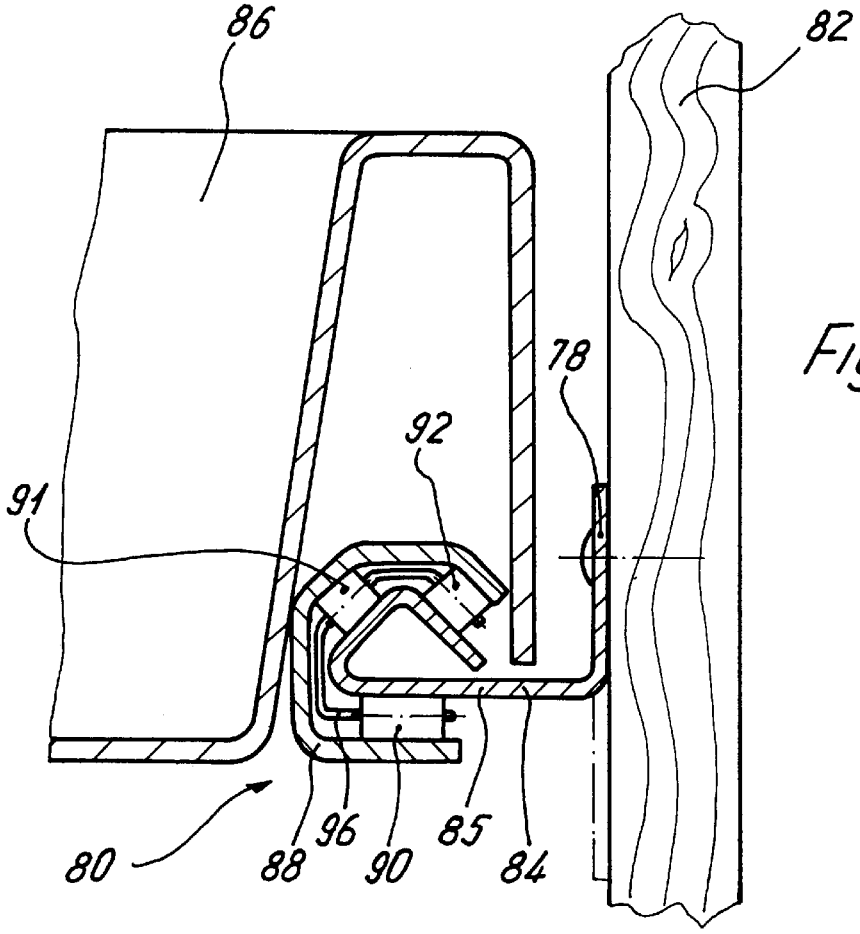
FIG. 12 is a view of an eighth embodiment of a pull-out slide according to the invention in which only two guide rails are provided.

The embodiment of a pull-out slide 80 illustrated in FIG. 12 is equipped with only two guide rails. A first guide rail 84 is fastened by way of a fastening flange 78 on a wall 82 of a piece of furniture. By way of fastening devices, which are not shown, a third guide rail 88 is connected with a drawer 86. Between the first guide rail 84 and the third guide rail 88, three roller bodies 90, 91 and 92 are arrange which roll on corresponding running surfaces on the guide rails. In this case, the roller bodies 90, 91 and 92 are connected with one another by way of a cradle 96. The first guide rail 84 and the third guide rail 88 are displaceably disposed such that the maximal pull-out distance is reduced in comparison to embodiments with more guide rails.

Figure 13:
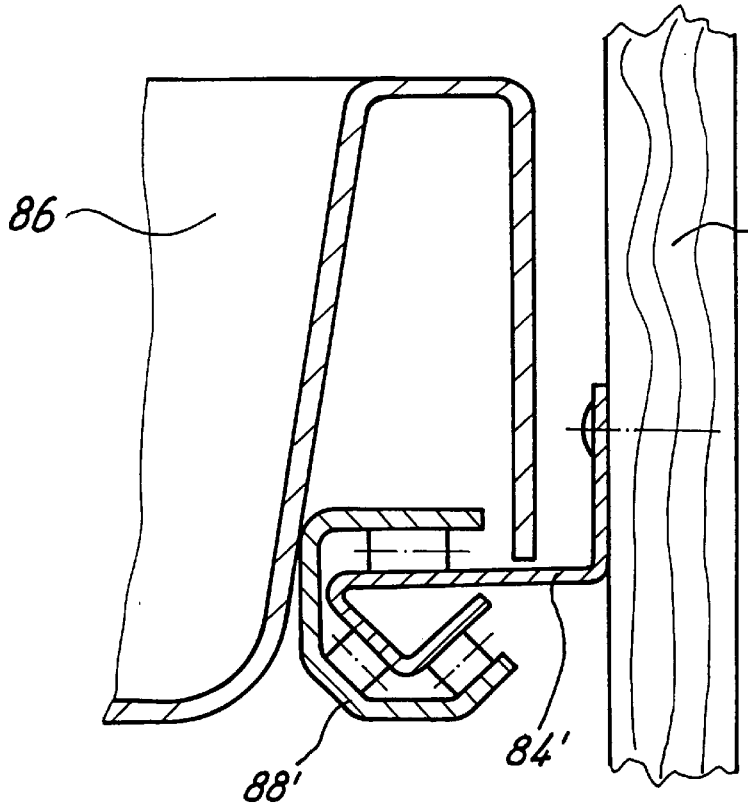
FIG. 13 is a view of a modification of the embodiment illustrated in FIG. 12.

The embodiment illustrated in FIG. 13 represents a modification of the preceding embodiment, in which the first guide rail 84' is provided with a downward-pointing triangular profile. Correspondingly, the third guide rail 88' has a horizontal flat construction on top, which may be advantageous for the fastening of the drawer 86.

Figure 14:
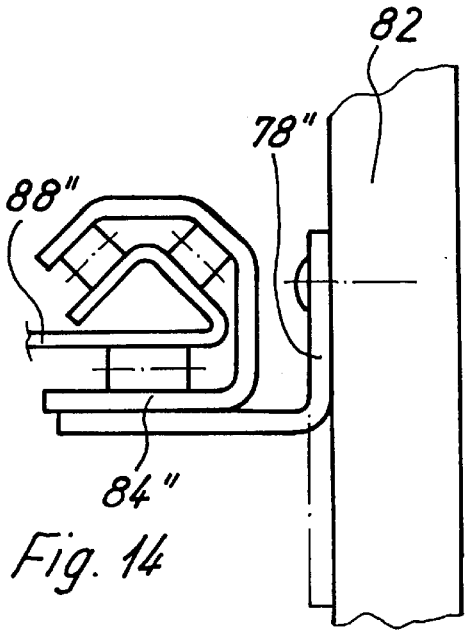
FIG. 14 is a view of a modification of the embodiment illustrated in FIG. 12.
Figure 15:
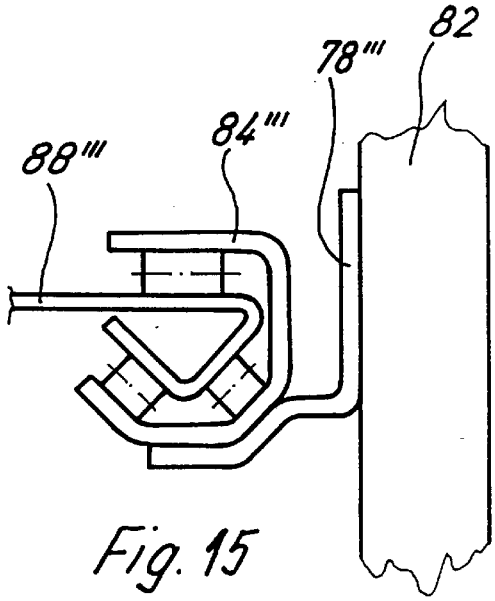
FIG. 15 is a view of a modification of the embodiment illustrated in FIG. 12.
Figure 16:
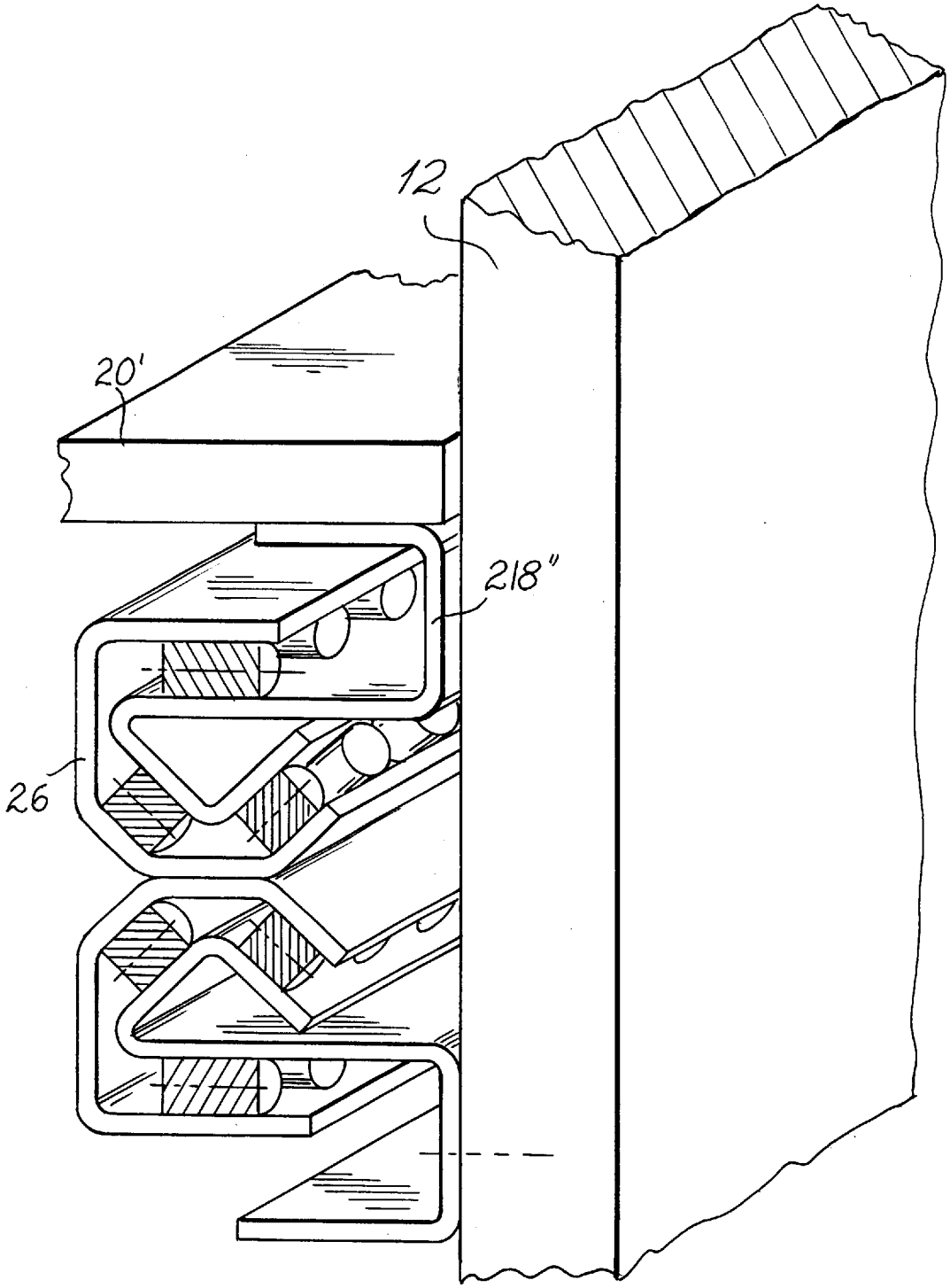
FIG. 16 is a perspective view of the pull-out slide with bearing units aligned back-to-back.

In the case of the pull-out slide according to FIG. 14, the first guide rail 84" is connected with the wall 82 of the piece of furniture by way of a separately constructed fastening flange 78". In contrast to the preceding embodiments, here the first guide rail 84" reaches around the third guide rail 88". According to FIG. 15, the fastening flange 78'" is additionally provided with a sloped guiding surface for aligning the first guide rail 84'". This facilitates the mounting of the first and third guide rail 84'" and 88'" on the wall 82 of the piece of furniture.

The illustrated embodiments are each only shown as a cross-sectional view of one bearing unit. The complete pull-out slide comprises at least two bearing units in the pull-out direction with several roller bodies arranged behind one another, the pull-out furniture part being equipped with one pull-out slide according to the invention at least on both sides.

Although the present invention has been described and illustrated in great detail, it is to be clearly understood that the same is by way of illustration and example only, and is not to be taken by way of limitation. The spirit and scope of the present invention are to be limited only by the terms of the appended claims.

We claim:

1. A pull-out slide for a telescoping furniture part comprising:

at least one stationary guide rail fastenable to a stationary furniture part;

at least one moving guide rail fastenable to a moving furniture part;

a first one of the guide rails being shaped with a slot extending substantially horizontally;

a bearing unit engaging the first one of the guide rails to allow relative movement in a displacement direction, the bearing unit having several cylindrical roller bodies such that axes of the cylindrical roller bodies are generally perpendicular to the displacement direction;

wherein, at least one first cylindrical roller body is arranged essentially horizontally and adjacent the slot, second and third cylindrical roller bodies are arranged such that their axes of rotation form a triangle with the axis of the first roller body such that all three axes are in a plane orthogonal to the direction of displacement; and a supporting web having a first portion engaging the roller bodies by extending through the slot of the first one of the guide rails and into the triangle formed by the roller body axes and connected to a second one of the guide rails by a second portion.

2. A pull-out slide according to claim 1, wherein the supporting web has triangularly arranged running surfaces.

3. A pull-out slide according to claim 1, wherein the first one of the guide rails reaches around the roller bodies and the supporting web.

4. A pull-out slide according to claim 3, wherein the first one of the guide rails has a pentagonal cross-section, such that three edges of the pentagon serve as runnnig surfaces and two edges connect two running surfaces with one another.

5. A pull-out slide according claim 1, wherein the bearing unit is comprised of several roller bodies arranged behind one another in the displacing direction.

6. A pull-out slide according to claim 1, further comprising two bearing units between the guide rails.

7. A pull-out slide for a telescoping furniture part comprising:

at least one stationary guide rail fastenable to a stationary furniture part;

at least one moving guide rail fastenable to a moving furniture part;

an intermediate guide rail displaceably disposed with respect to both the stationary guide rail and the moving guide rail;

a respective bearing unit positioned between the stationary guide rail and the intermediate rail and between the intermediate rail and the moving guide rail to allow relative movement in a displacement direction, the bearing units having several cylindrical roller bodies such that axes of the cylindrical roller bodies are generally perpendicular to the displacement direction;

wherein, at least one first cylindrical roller body is arranged essentially horizontally between the stationary guide rail and the intermediate rail, and between the intermediate rail and the moving rail, second and third cylindrical roller bodies are arranged such that their axes of rotation and the axis of rotation of the first cylindrical roller body form respective triangles in a plane orthogonal to the direction of displacement; and the intermediate guide rail includes a supporting web extending between respective first and second roller bodies into the triangles formed by the roller body axes, and engaging the roller bodies.

8. A pull-out slide according to claim 7 wherein the second guide rail has a C-shaped cross-section and is provided with one bend on each of two free legs of the C-shape, and wherein running surfaces engaging the second and third roller bodies are formed on the bends.

9. A pull-out slide according to claim 8, wherein the two free legs of the second guide rail form one running surface respectively for a horizontally arranged cylindrical roller body and are connected with one another by a connecting web.

10. A pull-out slide according to claim 9, wherein a cylindrical roller body is disposed on the connecting web and contacts the first guide rail and the third guide rail at a circumference of the cylindrical roller body.

11. A pull-out slide according to claim 7, wherein the intermediate guide rail has a E-shaped construction.

12. A pull-out slide according to claim 7, wherein the intermediate guide rail has an S-shaped construction.

13. A pull-out slide according to claim 7, wherein the intermediate guide rail has an Z-shaped construction.

* * * * *